US012471711B2

(12) United States Patent
Lake

(10) Patent No.: US 12,471,711 B2
(45) Date of Patent: Nov. 18, 2025

(54) LINEAR ACTUATOR AND LINKAGE SYSTEM FOR AN OTTOMAN OF RISER-MOUNTED THEATER SEAT CHAIRS

(71) Applicant: VIP LUXURY SEATING, LLC, New Albany, MS (US)

(72) Inventor: Stephen R. Lake, Tupelo, MS (US)

(73) Assignee: VIP LUXURY SEATING LLC, New Albany, MS (US)

( * ) Notice: Subject to any disclaimer, the term of this patent is extended or adjusted under 35 U.S.C. 154(b) by 0 days.

(21) Appl. No.: 18/115,804

(22) Filed: Mar. 1, 2023

(65) Prior Publication Data

US 2024/0292953 A1 Sep. 5, 2024

(51) Int. Cl.

| | |
|---|---|
| ***A47C 1/12*** | (2006.01) |
| ***A47C 1/121*** | (2006.01) |
| ***A47C 7/50*** | (2006.01) |

(52) U.S. Cl.

CPC ..... *A47C 7/5068* (2018.08); *A47C 1/12* (2013.01); *A47C 1/121* (2013.01)

(58) Field of Classification Search

CPC ..... A47C 7/5068; A47C 1/12; A47C 1/0345
See application file for complete search history.

(56) References Cited

U.S. PATENT DOCUMENTS

| | | | | |
|---|---|---|---|---|
| 5,368,366 A * | 11/1994 | Mizelle | A47C 1/0345 297/85 L |
| 5,695,239 A | 12/1997 | Johnson et al. | |
| 9,808,090 B2 * | 11/2017 | Carrera | A47C 7/506 |
| 10,888,162 B1 * | 1/2021 | McLennan | A47C 1/124 |
| 2016/0058191 A1 * | 3/2016 | Hegedus | A47C 1/0342 297/423.19 |
| 2020/0196759 A1 | 6/2020 | Johnson | |

FOREIGN PATENT DOCUMENTS

| | | | | |
|---|---|---|---|---|
| CN | 113520087 A * | 10/2021 | | |
| CN | 218960354 U * | 5/2023 | | A47C 1/034 |
| CN | 116691474 A * | 9/2023 | | |
| DE | 202023103511 U1 * | 8/2023 | | A47C 1/0242 |
| WO | WO-2019060437 A1 * | 3/2019 | | A47C 1/0123 |
| WO | WO-2022156781 A1 * | 7/2022 | | A47C 17/04 |

* cited by examiner

*Primary Examiner* — Timothy J Brindley
(74) *Attorney, Agent, or Firm* — LAW OFFICES OF STEVEN W. WEINRIEB

(57) ABSTRACT

A linear actuator and linkage system for an ottoman of a powered chair is disclosed an comprises an ottoman support upon which an ottoman is to be supported, a frame member, a plurality of linkage members operatively connecting the ottoman support to the frame member and for moving the ottoman support between a first closed/retracted position and a second open/extended position, and a linear actuator operatively connected to the plurality of linkage members for exerting a push force, in a first horizontally oriented direction, upon the plurality of linkage members, and for exerting a pull force in a second oppositely oriented horizontal direction upon the plurality of linkage members, the horizontally oriented forces providing the system with an enhanced mechanical advantage for easily moving the ottoman support. The powered chair is also uniquely adapted for use as a theater seat within stadium-type seating.

10 Claims, 5 Drawing Sheets

FIG. 1
(PRIOR ART)
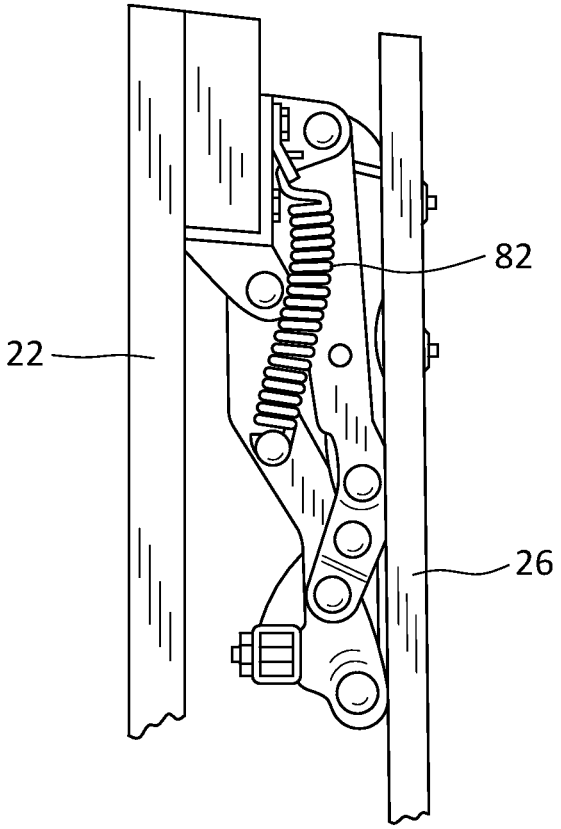
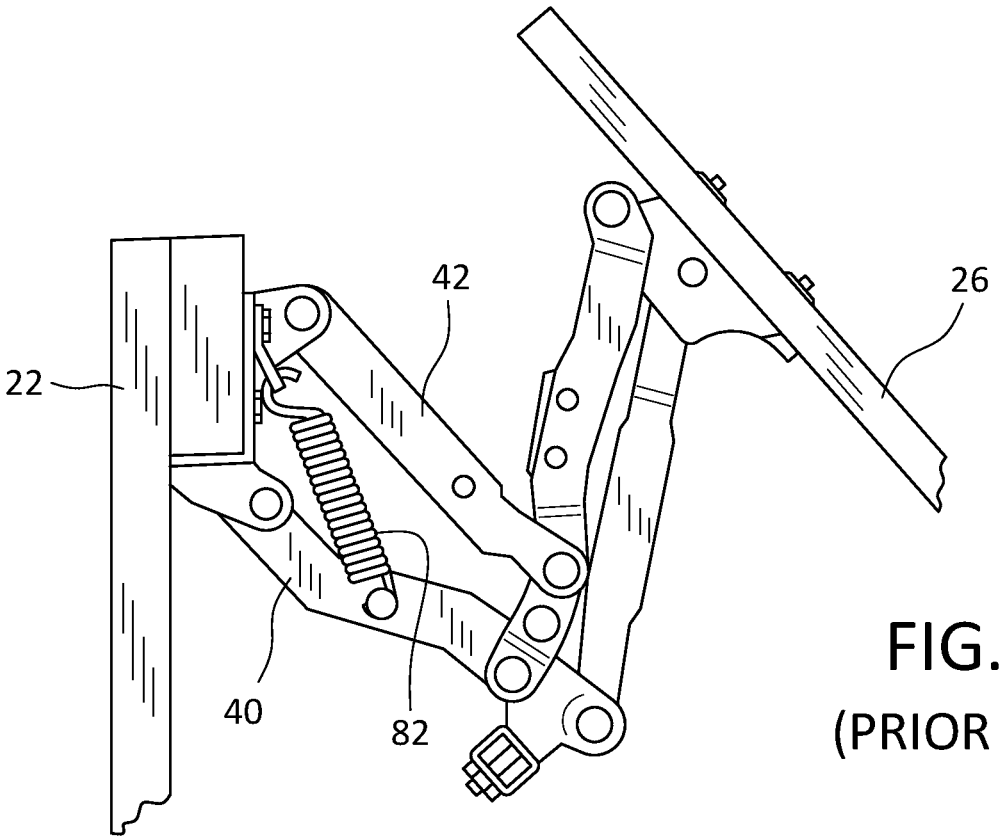
FIG. 2
(PRIOR ART)

LINEAR ACTUATOR AND LINKAGE SYSTEM FOR AN OTTOMAN OF RISER-MOUNTED THEATER SEAT CHAIRS

FIELD OF THE INVENTION

The present invention relates generally to powered chairs, and more particularly to a linear actuator and linkage system for an ottoman of riser-mounted theater seat chairs.

BACKGROUND OF THE INVENTION

Chairs or similar furniture pieces having movable ottomans, which are adapted to move from a retracted, stowed position at which the ottoman is disposed beneath the seat of the chair, to an extended position at which the legs of the occupant of the chair are supported in an elevated position in front of the chair, are of course well-known. One example of such a furniture piece is disclosed within U.S. Pat. No. 5,695,239 which issued to Johnson et al. on Dec. 9, 1997. In accordance with the disclosure of this noted patent, and as illustrated within FIGS. 1 and 2, which correspond to FIGS. 7 and 8 of the noted patent, the ottoman board 26 is adapted to be biased toward its extended position by means of a pair of oppositely disposed coiled springs 82 which are attached to lower, rear linkage members 40 which operatively connect the ottoman board 26 to a front frame member 22 of the chair. However, this type of system has proven to have several operational difficulties. For example, the linkage system effectively defines an over-center locking mechanism. Accordingly, since the coiled springs 82 are intended to bias the ottoman board 26 toward its extended position when the ottoman board 26 is to be moved from its retracted position toward its extended position, and since the coiled springs 82 were initially stretched when the ottoman board 26 was moved from the extended position to the retracted position, the coiled springs 82 will tend to retract, exert an upwardly oriented force upon the lower, rear linkage members 40, which force is effectively oriented parallel to, or colinear with, the retracted ottoman board 26, and which will also need to overcome the over-center locking disposition of the linkage members as defined by means of the over-center locking mechanism. Furthermore, despite the presence or definition of the over-center locking mechanism, the system requires a locking mechanism so as to ensure the fact that the ottoman board 26 will be maintained at the retracted position. Still further, in order to move the ottoman board back to its retracted position, the patent disclosure states that the occupant of the chair must first pull on the ottoman board in an inward direction toward the occupant so as to release the ottoman board from its extended position, and subsequently, the ottoman board 26 can be lowered or moved downwardly back toward its retracted position. Lastly, the coiled springs 82 will need to be stretched, and the force of the over-center locking mechanism will need to be overcome. It is thus quite apparent that this entire arrangement of the coiled springs 82 and the linkage members, comprising the over-center locking mechanism, defines a system that exhibits poor mechanical advantages, which therefore renders the system difficult to manipulate.

A need exists in the art for a new and improved actuator and linkage system for chairs. Another need exists in the art for a new and improved actuator system for chairs, wherein the actuator comprises a linear actuator. Still another need exists in the art for a new and improved actuator and linkage system for chairs, wherein the actuator comprises a linear actuator for use in conjunction with an ottoman, and wherein the ottoman is a component part of a theater seat chair. Yet another need exists in the art for a new and improved actuator and linkage system for chairs, wherein the actuator comprises a linear actuator for an ottoman, wherein the ottoman is a component part of a theater seat chair, and wherein the linear actuator is operatively connected to the ottoman such that the linear actuator exerts push and pull forces upon the ottoman linkage system in a substantially horizontal direction. Yet still another need exists in the art for a new and improved actuator and linkage system for chairs wherein the actuator comprises a linear actuator for an ottoman wherein the ottoman is a component part of a theater seat chair, and wherein the linear actuator is operatively connected to the ottoman such that the linear actuator exerts push and pull forces upon the ottoman linkage system in a substantially horizontal direction so as to maximize the ease and efficiency of moving the ottoman between its extended and retracted positions. Still yet another need exists in the art for a new and improved actuator and linkage system for chairs wherein the actuator comprises a linear actuator for an ottoman, wherein the ottoman is a component part of a theater seat chair, wherein a linkage system operatively connects the linear actuator to the ottoman, and wherein the linkage system comprises a thin profile linkage system. A further need exists in the art for a new and improved actuator and linkage system for chairs wherein the actuator comprises a linear actuator for an ottoman, wherein the ottoman is a component part of a theater seat chair, wherein a linkage system operatively connects the linear actuator to the ottoman, wherein the linkage system comprises a thin profile linkage system, and wherein the thin profile linkage system is particularly advantageous for use within riser-mounted theater seats chairs.

A still further need exists in the art for a new and improved actuator and linkage system for chairs, wherein the actuator comprises a linear actuator for an ottoman, wherein the ottoman is a component part of a theater seat chair, wherein the linkage system operatively connects the linear actuator to the ottoman, wherein the linkage system comprises a thin profile linkage system, wherein the thin profile linkage system is particularly advantageous for use within riser-mounted theater seats chairs, and wherein the thin profile linkage system permits the ottoman to be disposed at its retracted position beneath the seat of the theater chair. A yet further need exists in the art for a new and improved actuator and linkage system for chairs, wherein the actuator comprises a linear actuator for an ottoman, wherein the ottoman is a component part of a theater seat chair, wherein the linkage system operatively connects the linear actuator to the ottoman, wherein the linkage system comprises a thin profile linkage system, wherein the thin profile linkage system is particularly advantageous for use within riser-mounted theater seats chairs, wherein the thin profile linkage system permits the ottoman to be disposed at its retracted position beneath the seat of the theater chair, and wherein the thin-profile linkage system permits the linkage system and ottoman to be disposed in front of the riser of theater stadium seating.

Overall Objectives of the Invention

Therefore, an overall objective of the present invention is to provide a new and improved actuator and linkage system for chairs. Another overall objective of the present invention is to provide a new and improved actuator system for chairs, wherein the actuator comprises a linear actuator. Still another overall objective of the present invention is to provide a new and improved actuator and linkage system for chairs, wherein the actuator comprises a linear actuator for use in conjunction with an ottoman, and wherein the ottoman is a component part of a theater seat chair. Yet another overall objective of the present invention is to provide a new and improved actuator and linkage system for chairs, wherein the actuator comprises a linear actuator for an ottoman, wherein the ottoman is a component part of a theater seat chair, and wherein the linear actuator is operatively connected to the ottoman such that the linear actuator exerts push and pull forces upon the ottoman linkage system in a substantially horizontal direction. Yet still another overall objective of the present invention is to provide a new and improved actuator and linkage system for chairs wherein the actuator comprises a linear actuator for an ottoman wherein the ottoman is a component part of a theater seat chair, and wherein the linear actuator is operatively connected to the ottoman such that the linear actuator exerts push and pull forces upon the ottoman linkage system in a substantially horizontal direction so as to maximize the ease and efficiency of moving the ottoman between its extended and retracted positions. Still yet another overall objective of the present invention is to provide a new and improved actuator and linkage system for chairs wherein the actuator comprises a linear actuator for an ottoman, wherein the ottoman is a component part of a theater seat chair, wherein a linkage system operatively connects the linear actuator to the ottoman, and wherein the linkage system comprises a thin profile linkage system. A further overall objective of the present invention is to provide a new and improved actuator and linkage system for chairs wherein the actuator comprises a linear actuator for an ottoman, wherein the ottoman is a component part of a theater seat chair, wherein a linkage system operatively connects the linear actuator to the ottoman, wherein the linkage system comprises a thin profile linkage system, and wherein the thin profile linkage system is particularly advantageous for use within riser-mounted theater seats chairs.

A still further overall objective of the present invention is to provide a new and improved actuator and linkage system for chairs, wherein the actuator comprises a linear actuator for an ottoman, wherein the ottoman is a component part of a theater seat chair, wherein the linkage system operatively connects the linear actuator to the ottoman, wherein the linkage system comprises a thin profile linkage system, wherein the thin profile linkage system is particularly advantageous for use within riser-mounted theater seats chairs, and wherein the thin profile linkage system permits the ottoman to be disposed at its retracted position beneath the seat of the theater chair. A yet further overall objective of the present invention is to provide a new and improved actuator and linkage system for chairs, wherein the actuator comprises a linear actuator for an ottoman, wherein the ottoman is a component part of a theater seat chair, wherein the linkage system operatively connects the linear actuator to the ottoman, wherein the linkage system comprises a thin profile linkage system, wherein the thin profile linkage system is particularly advantageous for use within riser-mounted theater seats chairs, wherein the thin profile linkage system permits the ottoman to be disposed at its retracted position beneath the seat of the theater chair, and wherein the thin-profile linkage system permits the linkage system and ottoman to be disposed in front of the riser of theater stadium seating.

SUMMARY OF THE INVENTION

The foregoing and other objectives are achieved in accordance with the principles and teachings of the present invention by providing a new and improved linear actuator and linkage system for an ottoman of riser-mounted theater seat chairs comprising an ottoman board, upon which an ottoman is adapted to be fixedly secured, a linear actuator which has its motor end pivotally connected to a mounting bracket fixedly mounted upon a frame member of the chair, and the extendable/retractable tube or rod pivotally connected to a cross-beam which extends transversely between an upper pair of oppositely disposed sets of linkage members which connect the ottoman board to another frame member of the chair. In this manner, not only does the extendable/retractable tube or rod of the linear actuator exert a push force upon the ottoman board, which is oriented in a substantially horizontal direction that is effectively perpendicular to the ottoman board when the ottoman board is disposed at it closed or retracted position, so as to move the ottoman board from its closed or retracted position to its open or extended position, but in addition, the extendable/retractable tube or rod of the linear actuator likewise or conversely exerts a pull force upon the ottoman board and the upper pair of oppositely disposed sets of linkage members in the opposite substantially horizontal direction when the ottoman board is to be moved from its open or extended position to its closed or retracted position. This structural arrangement of the various operational components is therefore appreciated to be much more efficient than the prior art system of Johnson et al. in that the substantially horizontally oriented forces define a mechanical advantage which is far superior to the vertically oriented forces characteristic of the Johnson et al. coiled spring mechanism. More particularly, in lieu of the spring forces of Johnson et al. effectively being oriented in a direction that is effectively colinear with the lower linkage member 40, the linear actuator of the present invention exerts forces upon the upper linkage members of the present invention linkage system which are effectively perpendicular to the upper linkage members of the present invention linkage system. In addition, it can also be appreciated that the linear actuator controls the disposition of the linkage members and the ottoman board, thereby eliminating any need for an over-center locking mechanism, or locking devices for maintaining the ottoman board both at the open or extended position, as well as at the closed or retracted position.

Still further, the new and improved linear actuator and linkage system for an ottoman is particularly desirable for use upon riser-mounted theater seat chairs, and especially within newer theaters which now employ stadium-type seating. More particularly, the new and improved linear actuator and linkage system defines a thin-profile system wherein the linkage members can be stowed beneath the front of the chair seat and in front of a riser of the stadium-type theater seating when the chair is fixedly mounted upon a tread portion of the stadium-type theater seating arrangement. Yet further, the linear actuator is nevertheless fully functional so as to be capable of moving the ottoman board between its open or extended and closed or retracted positions. Still yet further, the new and improved chair is also provided with a reclining backrest, wherein the reclining and upright positions are controlled by another linear actuator and back mounting brackets, and lastly, the seat portion of the chair is capable of being moved upwardly and forwardly so as to facilitate cleaning as well as any maintenance or repair which may be required in connection with the linear actuator.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is a side elevation view of a conventional, PRIOR ART ottoman system as disclosed within U.S. Pat. No. 5,695,239, wherein the ottoman is disclosed at its closed or retracted position;

FIG. 2 is a side elevation view of the conventional, PRIOR ART ottoman system as disclosed within U.S. Pat. No. 5,695,239, and as disclosed within FIG. 1, wherein the ottoman is disclosed at its open or extended position;

Figure 6:
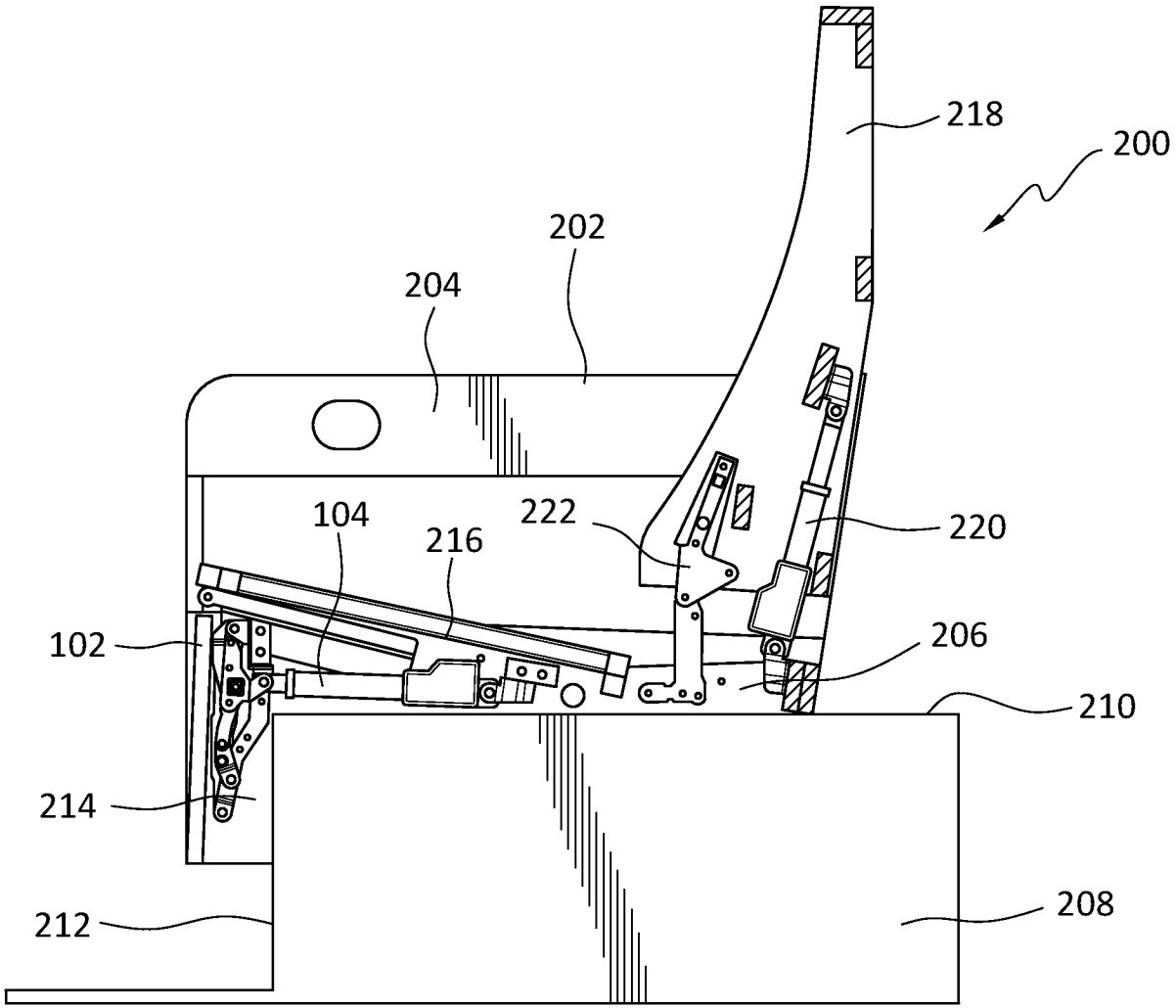
Figure 7:
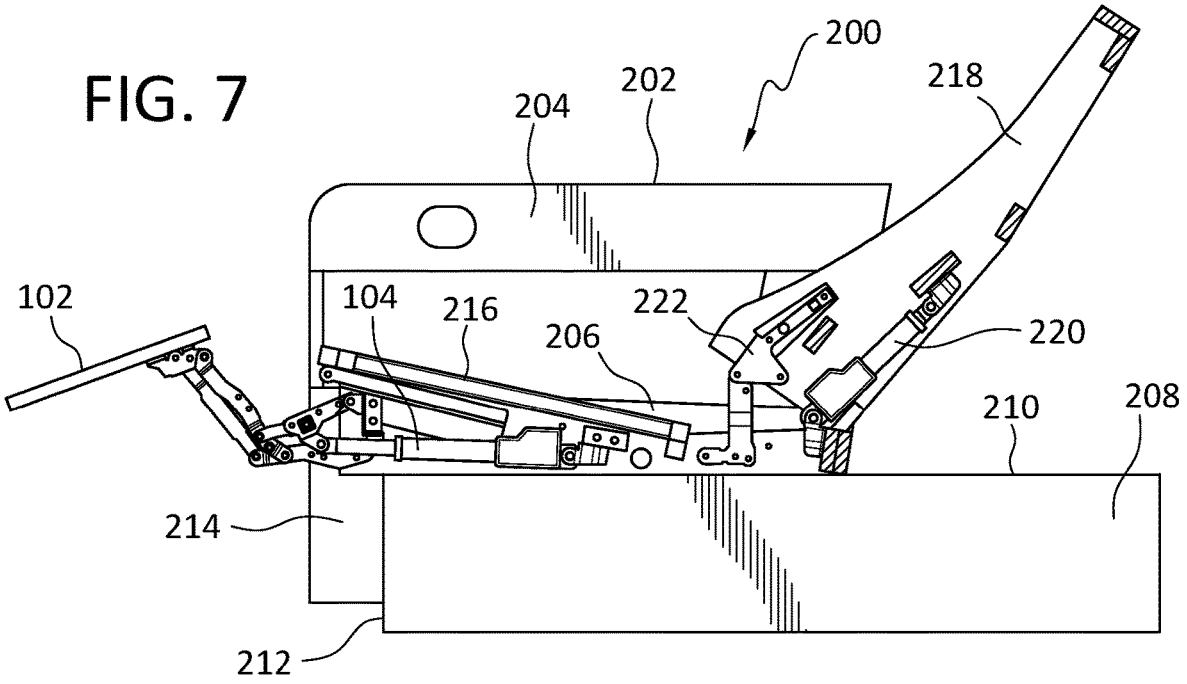
Figure 8:
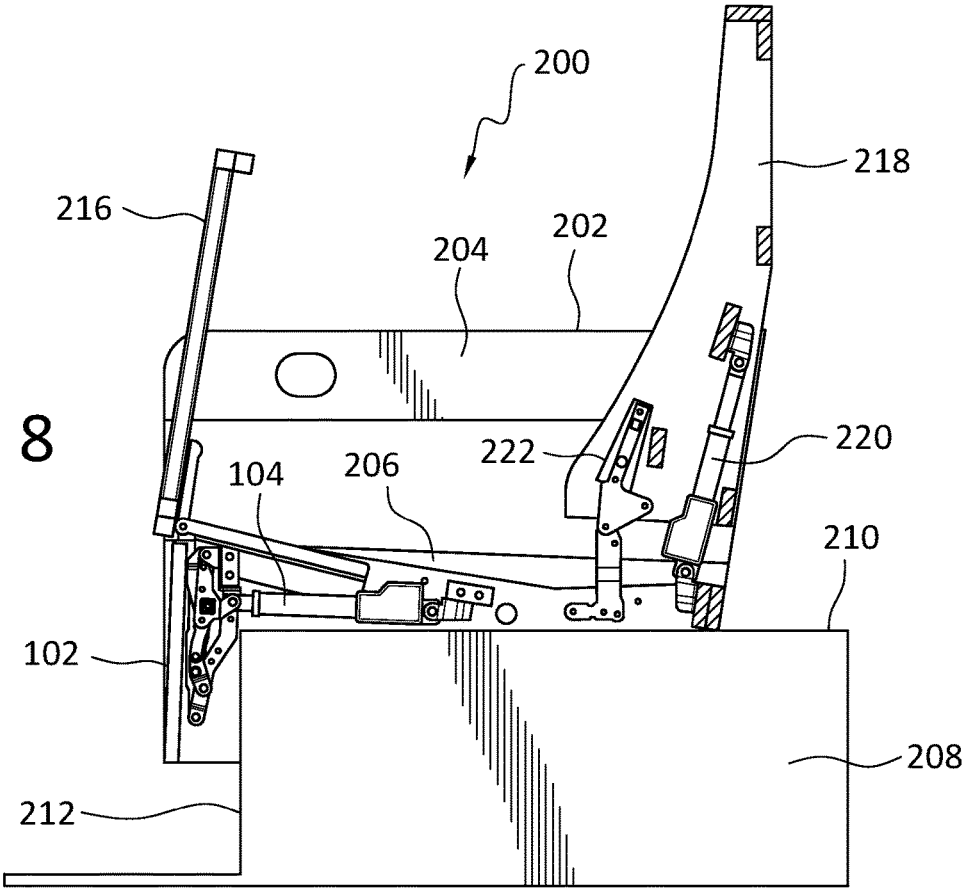

FIG. 6 is a side elevation view showing the new and improved linear actuator and linkage system as mounted upon a stadium-type seating chair wherein the ottoman board is disposed at its closed or retracted position, the backrest is disposed at its upright position, and the linkage system, characterized by its thin profile, is disposed beneath the front of the chair seat and in front of the riser section of the stadium-type seating arrangement;

FIG. 7 is a side elevation view showing the new and improved linear actuator and linkage system as mounted upon a stadium-type seating chair wherein the ottoman board is disposed at its open or extended position, and the backrest is disposed at its reclined position; and FIG. 8 is a side elevation view showing the new and improved linear actuator and linkage system as mounted upon a stadium-type seating chair wherein the ottoman board is disposed at its closed or retracted position, the backrest is disposed at its upright position, the linkage system, characterized by its thin profile, is disposed beneath the front of the chair seat and in front of the riser section of the stadium-type seating arrangement, and wherein the seat of the chair has been opened, by moving the same upwardly and forwardly, such that the interior of the chair is exposed so as to facilitate cleaning as well as to provide access to the linear actuator should maintenance, replacement, or repair be needed.

DETAILED DESCRIPTION OF THE PREFERRED EMBODIMENT

Figure 3:
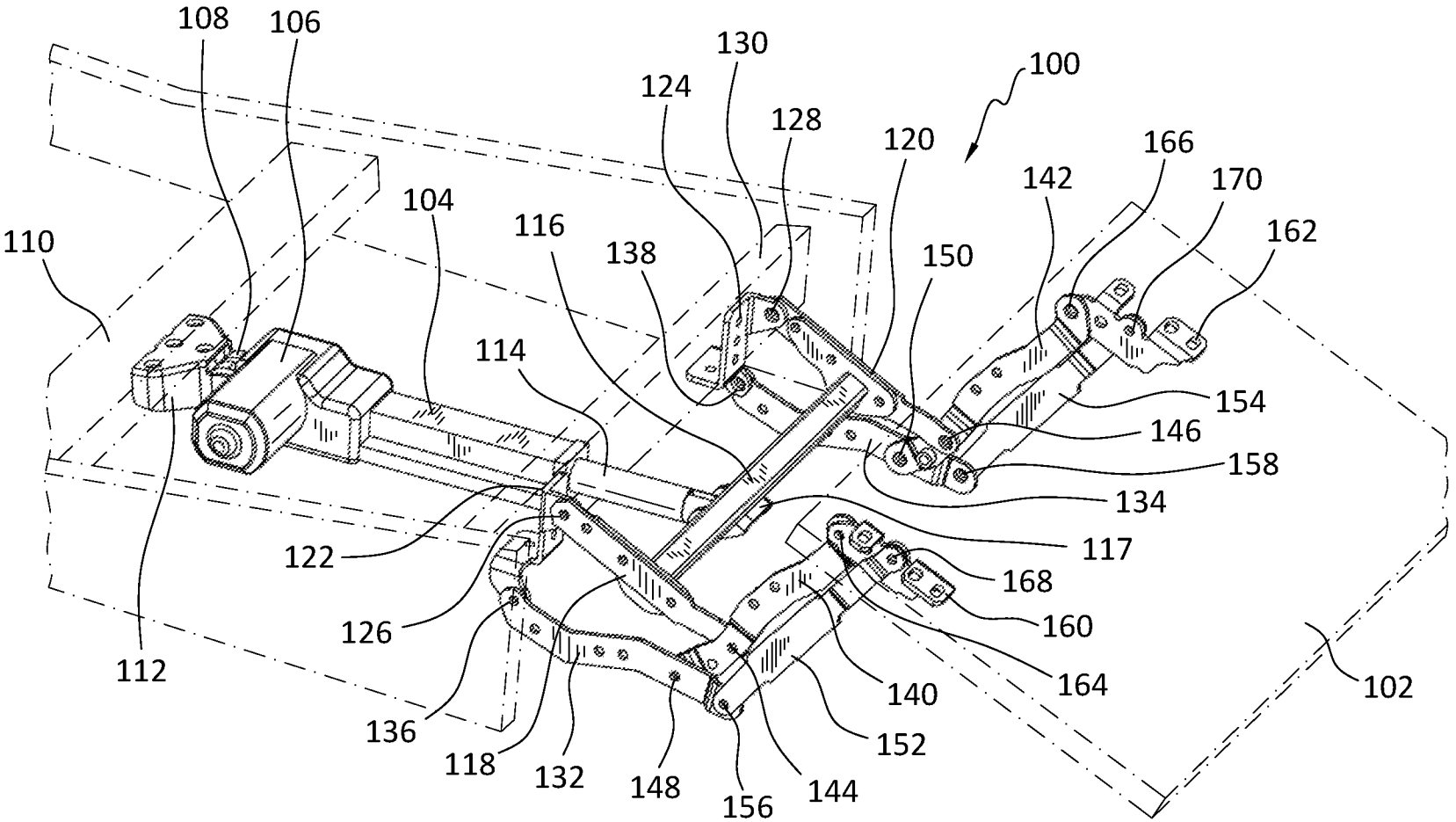
FIG. 3 is a perspective view of the new and improved linear actuator and linkage system for moving an ottoman board of a chair between its open or extended and its closed or retracted positions.

Referring now to the drawings, and in particular to FIG. 3 thereof, a new and improved linear actuator and linkage system for an ottoman of a riser-mounted theater seat chair is illustrated and is generally indicated by the reference character 100. More particularly, it is seen that the new and improved linear actuator and linkage system for an ottoman of a riser-mounted theater seat chair 100 of the present invention comprises an ottoman board or similar support 102, upon which an ottoman, not shown, is adapted to be fixedly secured, and a linear actuator 104 which has its motor end 106 pivotally connected to a mounting bracket, such as, for example, a first clevis-type connector 108, fixedly mounted upon a first, transversely oriented frame member 110 of the chair by means of a suitable mounting bracket 112, while the extendable/retractable tube or rod 114 is pivotally connected to a cross-beam member 116, by means of a second clevis-type connector 117 which extends transversely between an upper pair of laterally spaced, oppositely disposed, rearward linkage members 118, 120, the cross-beam member 116 providing enhanced stability to the linkage system. Inner or rear end portions of the upper pair of laterally spaced, oppositely disposed, rearward linkage members 118, 120 are pivotally connected to ear portions of a pair of laterally spaced, oppositely disposed L-shaped mounting brackets 122, 124, by pivot connections 126, 128, wherein the L-shaped mounting brackets 122, 124 are adapted to be fixedly connected to a second transversely oriented frame member 130 of the chair. Continuing further, a lower pair of laterally spaced, oppositely disposed rearward linkage members 132, 134 are pivotally connected to dependent appendages of the L-shaped mounting brackets 122, 124, by pivot connections 136, 138, and it is seen that forward end portions of the upper pair of laterally spaced, oppositely disposed, rearward linkage members 118, 120 are pivotally connected to intermediate portions of an upper pair of laterally spaced, oppositely disposed, forward linkage members 140, 142 by pivot connections 144, 146. In a similar manner, lower end portions of the upper pair of laterally spaced, oppositely disposed, forward linkage members 140,142 are pivotally connected to intermediate portions of the lower pair of laterally spaced, oppositely disposed rearward linkage members 132, 134 as at pivot connections 148, 150, while lower end portions of a lower pair of laterally spaced, oppositely disposed, forward linkage members 152, 154 are pivotally connected to forward end portions of the lower pair of laterally spaced, oppositely disposed rearward linkage members 132, 134 as at pivotal connections 156, 158. It is lastly seen that upper end portions of the upper pair of laterally spaced, oppositely disposed, forward linkage members 140, 142, and the upper end portions of the lower pair of laterally spaced, oppositely disposed, forward linkage members 152, 154 are pivotally connected to a pair of laterally spaced mounting brackets 160, 162, as at pivotal connections 164, 166 and 168, 170, wherein it is seen that the mounting brackets 160, 162 are fixedly mounted upon the rear or back or interior surface of the ottoman board 102.

Figure 4:
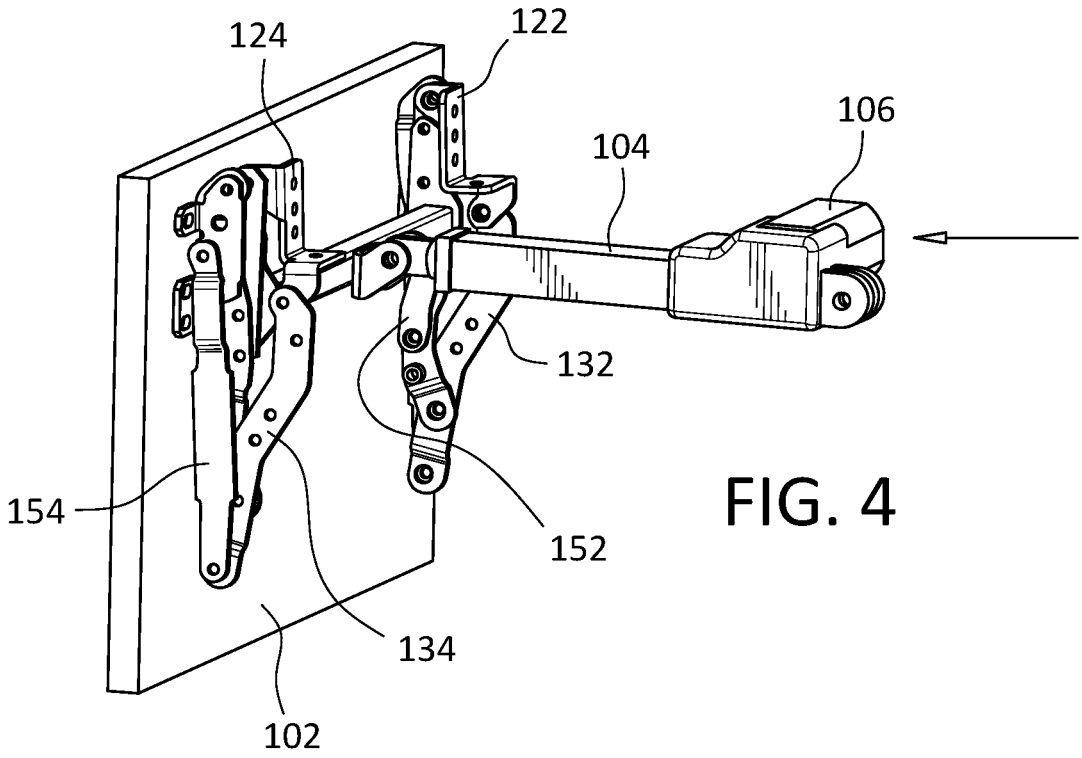
FIG. 4 is a perspective view showing the new and improved linear actuator and linkage system operatively connected to the ottoman board and wherein the ottoman board is disposed at its closed or retracted position.
Figure 5:
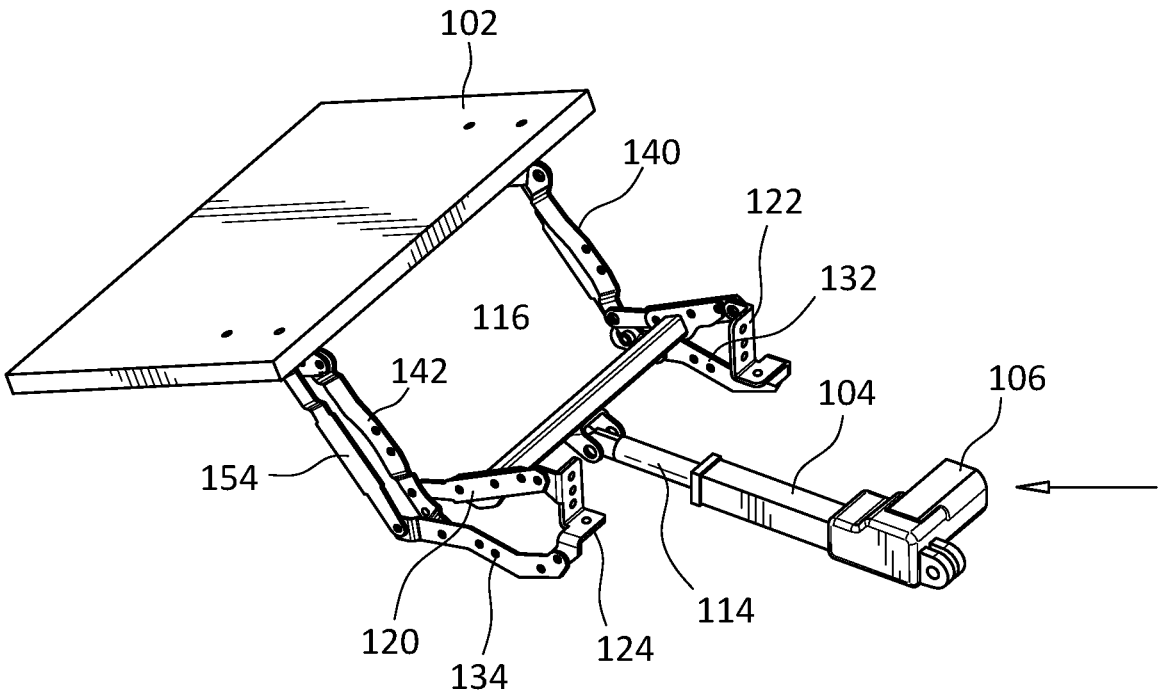
FIG. 5 is a perspective view showing the new and improved linear actuator and linkage system operatively connected to the ottoman board and wherein the ottoman board is disposed at its open or extended position.

As can therefore be readily appreciated from the foregoing, the ottoman board 102 is mounted upon the chair, and its movements between the open or extended position and the closed or retracted position are controlled, by the linear actuator 104 and the various linkage members 118, 120, 132, 134, 140, 142, 152, 154. More particularly, as can best be appreciated from FIGS. 4 and 5, it is seen that when the extendable/retractable tube or rod 114 of the linear actuator 104 exerts a push force upon the ottoman board 102 as a result of the extendable/retractable tube or rod 114 being moved toward its extended position as illustrated within FIG. 5, the push force is oriented in a substantially horizontal direction that is effectively perpendicular to the ottoman board 102, which is oriented vertically downwardly when the ottoman board 102 is disposed at it closed or retracted position as is illustrated within FIG. 4, so as to move the ottoman board 102 from its closed or retracted position to its open or extended position in a significantly efficient manner. Likewise, when the extendable or retractable tube or rod 114 of the linear actuator 104 is retracted so as to move the ottoman board 102 from its open or extended position as illustrated within FIG. 5, to its closed or retracted position as illustrated within FIG. 4, the linear actuator 104 will exert a pull force upon the ottoman board 102 in the opposite substantially horizontal direction. This structural arrangement of the various operational components is therefore appreciated to be much more efficient than the prior art system in that the substantially horizontally oriented forces define a mechanical advantage which is far superior to the vertically oriented forces characteristic of the prior art coiled spring mechanism. More particularly, in lieu of the spring forces of the prior art system being oriented in a direction that is effectively colinear with the lower linkage members, the linear actuator 104 of the present invention exerts forces upon the upper linkage members 118, 120, 140, 142 of the present invention linkage system which are effectively perpendicular to the upper linkage members 118, 120, 140, 142 of the present invention linkage system. In addition, it can also be appreciated that the linear actuator controls the disposition of the linkage members and the ottoman board 102, thereby eliminating any need for an over-center locking mechanism, or locking devices for maintaining the ottoman board 102 both at the open or extended position, as well as at the closed or retracted position.

Still further, the new and improved linear actuator and linkage system for an ottoman is particularly desirable for use upon riser-mounted theater seat chairs, especially within newer theaters which now employ stadium-type seating. More particularly, with reference being made to FIGS. 6-8, it can be seen that in accordance with current stadium-type seating arrangements, the typical stadium-type chair, generally indicated by the reference number 200, is seen to comprise a frame 202 which, in turn, comprises oppositely disposed arms 204, 204, only one of which is shown, and a base 206. A step of the theater stadium seating is shown at 208 and is seen to comprise a tread portion 210, to which the base 206 of the chair 200 is affixed, and a riser portion 212. The front part of the base 206 includes a dependent portion 214 which is adapted to be disposed in front of the riser portion 212 of the step 208, and it is to be appreciated that this dependent portion 214 of the base 206 effectively defines an open chamber within which the ottoman board 102 and the plurality of linkage members 118, 120, 132, 134, 140, 142, 152, 154 are capable of being stored or stowed when the ottoman board 102 has been moved to its closed or retracted position, the linkage members 118, 120, 132, 134 140, 142, 152, 154 defining a thin-profile linkage system which enables or facilitates the linkage members 118, 120, 132, 134, 140, 142, 152, 154 being stowed or stored beneath the front portion of a chair seat 216 and in front of the riser 212 of the stadium-type theater seating when the chair is fixedly mounted upon the tread portion 210 of the stadium-type theater seating arrangement. It is also seen and appreciated that the linear actuator 104 is disposed beneath the chair seat 216 and is operatively connected to the plurality of linkage members 118, 120, 132, 134, 140, 142, 152, 154 so as to nevertheless be fully functional so as to be capable of moving the ottoman board 102 between its open or extended and closed or retracted positions. Still yet further, the new and improved chair is also provided with a reclining backrest 218, wherein the reclining and upright positions are controlled by a second linear actuator 220 and back mounting brackets 222. Lastly, the seat portion 216 of the chair 200 is capable of being moved upwardly and forwardly so as to facilitate cleaning as well as any maintenance or repair which may be required in connection with the linear actuator 104.

Obviously, many variations and modifications of the present invention are possible in light of the above teachings. It is therefore to be understood that within the scope of the appended claims, the present invention may be practiced otherwise than as specifically described herein.

What is claimed is:

1. A powered chair having a linear actuator and linkage system for moving an ottoman of said powered chair, and adapted to be mounted upon a step of a stadium-type theater seating arrangement, wherein the step of the stadium-type theater seating arrangement comprises a tread portion and a riser portion, the powered chair comprising:

a chair frame base adapted to be affixed to the tread portion of the step of the stadium-type theater seating arrangement, wherein said chair frame base comprises a front dependent portion which defines a forward open chamber and which is adapted to be disposed in front of the riser portion of the step of the stadium-type theater seating arrangement;

an ottoman support upon which an ottoman is to be supported;

pairs of oppositely disposed linkage members having first end portions pivotally connected to said chair frame base, and second end portions pivotally connected to said ottoman support for operatively connecting said ottoman support to said chair frame base and for moving said ottoman support between a first closed/retracted position at which said ottoman support has a substantially vertical orientation and which is disposed within said open chamber of said front dependent portion of said chair frame base along with said plurality of linkage members, and a second open/extended position at which said ottoman support has a substantially horizontal orientation;

and a linear actuator, having a first end portion mounted upon said chair frame base, and a second end portion operatively connected to said pairs of oppositely disposed linkage members, for exerting a push force, in a first horizontally oriented direction, upon said pairs of oppositely disposed linkage members, wherein said push force is effectively oriented perpendicular to said ottoman support, when said ottoman support is disposed at said first closed/retracted position, so as to move said ottoman support from said first closed/retracted position toward said second open/extended position, and for exerting a pull force, in a second oppositely oriented horizontal direction, upon said pairs of oppositely disposed linkage members, so as to move said ottoman support from said second open/extended position toward said first closed/retracted position.

2. The chair as set forth in claim 1, wherein:

said plurality of linkage members comprises pairs of oppositely disposed upper and lower rearward linkage members, and pairs of upper and lower forward linkage members, wherein said pairs of oppositely disposed upper and lower rearward linkage members are pivotally mounted upon said chair frame base.

3. The chair as set forth in claim 2, wherein:

said linear actuator is operatively connected to said pair of upper rearward linkage members.

4. The chair as set forth in claim 2, wherein:

a cross-beam interconnects said pair of upper rearward linkage members for providing enhanced stability to said linkage system.

5. The chair as set forth in claim 4, wherein:

said linear actuator is operatively connected to said cross-beam member.

6. The chair as set forth in claim 1, wherein:

said powered chair comprises a reclining backrest; and a second linear actuator is operatively connected to said reclining backrest so as to move said reclining backrest between upright and reclining positions, such elevational movements of the head and foot ends of the upper frame may be continuously varied such that a "floating on waves" mode of operation may be achieved.

7. The chair as set forth in claim 1, wherein:

said powered chair comprises a seat portion.

8. The chair as set forth in claim 7, wherein:

said linear actuator is disposed beneath said seat portion.

9. The chair as set forth in claim 8, wherein:

said seat portion is movable to an open position so as to provide access to said linear actuator.

10. The chair as set forth in claim 9, wherein:

said seat portion is pivotally mounted at its front end portion to said chair frame base such that a rear end portion of said seat portion is moved upwardly and forwardly when said seat portion is moved from a closed position to said open position.

* * * * *